US009540868B2

(12) United States Patent
Chen

(10) Patent No.: US 9,540,868 B2
(45) Date of Patent: Jan. 10, 2017

(54) MAGNETICALLY ATTRACTIVE SHADE

(71) Applicant: My Home Global Company, Ershui Township, Changhua County (TW)

(72) Inventor: Ju-Huai Chen, Ershui Township (TW)

(73) Assignee: My Home Global Company, Ershui Township (TW)

( * ) Notice: Subject to any disclaimer, the term of this patent is extended or adjusted under 35 U.S.C. 154(b) by 0 days.

(21) Appl. No.: 14/691,609

(22) Filed: Apr. 21, 2015

(65) Prior Publication Data

US 2016/0312527 A1 Oct. 27, 2016

(51) Int. Cl.
*E06B 9/262* (2006.01)

(52) U.S. Cl.
CPC ..... *E06B 9/262* (2013.01); *E06B 2009/2622* (2013.01)

(58) Field of Classification Search
CPC ..... E06B 9/262; E06B 2009/2622
See application file for complete search history.

(56) References Cited

U.S. PATENT DOCUMENTS 4,785,494 A * 11/1988 Adamski ..... B60J 5/062 16/95 R
4,799,525 A * 1/1989 Seymour ..... E06B 9/11 160/133
6,571,851 B1 * 6/2003 Jelic ..... E06B 9/262 160/107
8,905,114 B1 * 12/2014 Whitaker ..... E06B 9/262 160/348
2006/0086469 A1 * 4/2006 Nien ..... E06B 9/40 160/243
2006/0249260 A1 * 11/2006 Nien ..... A47H 13/00 160/84.03
2011/0214822 A1 * 9/2011 Lin ..... E06B 9/24 160/121.1
2012/0103539 A1 * 5/2012 Chen ..... E06B 9/24 160/113
2012/0234502 A1 * 9/2012 Chen ..... E06B 9/262 160/84.01
2013/0233497 A1 * 9/2013 Birtles ..... E06B 9/262 160/89
2014/0027070 A1 * 1/2014 Birkestrand ..... E06B 9/36 160/168.1 V
2016/0053535 A1 * 2/2016 Birkestrand ..... E06B 9/364 160/218

* cited by examiner

*Primary Examiner* — Katherine Mitchell
*Assistant Examiner* — Scott Denion
(74) *Attorney, Agent, or Firm* — Alan D. Kamrath; Kamrath IP Lawfirm, P.A.

(57) ABSTRACT

A shade includes a main unit and a plurality of magnetic members. The main unit includes a shade cloth member and a plurality of transverse bars. The shade cloth member is provided with a first tubular portion and a second tubular portion and divided into a first shading portion and a second shading portion. The second shading portion is divided into a plurality of movable shading pieces each provided with a plurality of transverse mounting sleeves. The transverse bars are mounted in the second tubular portion and the mounting sleeves. The magnetic members are mounted in the transverse bars. Thus, the second shading portion can regulate the incident sunlight passing through the shade cloth member by expanding, partially folding or fully folding each of the movable shading pieces to adjust the shading effect of the shade cloth member.

9 Claims, 8 Drawing Sheets

MAGNETICALLY ATTRACTIVE SHADE

BACKGROUND OF THE INVENTION

1. Field of the Invention

The present invention relates to a window covering and, more particularly, to a magnetically attractive shade.

2. Description of the Related Art

A conventional roman shade comprises a headrail, a shade cloth mounted on and extended from the headrail, a plurality of transverse rods mounted on the shade cloth, and a lift cord extended through the shade cloth and secured to the bottom of the shade cloth to move the shade cloth upward and downward. When the lift cord is pulled, the transverse rods are driven and moved to roll or expand the shade cloth. Thus, the shade cloth is lifted and folded by the lift cord to allow passage of the solar rays and is lowered and expanded by the lift cord to provide a shading effect. However, when the shade cloth is fully expanded, the solar rays cannot penetrate the shade cloth so that the indoor light is too weak, and when the shade cloth is fully folded, the solar rays are directly projected into the indoor so that the indoor light is too strong. In addition, the shade cloth has a constant light permeability, so that the shade cloth provides a single shading effect without changing the indoor viewing effect and cannot satisfy the user's different requirements. Further, when the shade cloth is fully folded, the indoor condition is exposed to the ambient environment, so that the conventional roman shade cannot prevent a person from peeping outdoors, thereby decreasing the privacy of the house. Further, the lift cord depends from a side of the roman shade so that the lift cord is easily tangled with a child's neck, thereby causing danger to the child. Further, the lift cord protrudes outwardly from the roman shade and is swayed or deflected easily due to a wind blowing, thereby decreasing the aesthetic quality of the roman shade.

BRIEF SUMMARY OF THE INVENTION

The primary objective of the present invention is to provide a magnetically attractive shade that can regulate the shading effect and the indoor brightness.

In accordance with the present invention, there is provided a shade comprising a main unit and a plurality of magnetic members mounted on the main unit. The main unit includes a shade cloth member and a plurality of transverse bars mounted on the shade cloth member. The shade cloth member is provided with a first tubular portion and a second tubular portion. The shade cloth member is divided into a first shading portion and a second shading portion. The second shading portion is divided into a plurality of movable shading pieces which are juxtaposed to each other. Each of the movable shading pieces is provided with a plurality of transverse mounting sleeves so that each of the movable shading pieces presents a multi-stage state. The transverse bars are mounted in the second tubular portion and the mounting sleeves of the movable shading pieces, with a respective transverse bar being mounted in the second tubular portion, and with respective transverse bars being mounted in respective mounting sleeves of the movable shading pieces. The magnetic members are mounted in the transverse bars and are magnetically attracted by each other.

Preferably, the first tubular portion, the second tubular portion and each of the mounting sleeves are formed by rolling the shade cloth member.

Preferably, each of the magnetic members has a profile corresponding to that of each of the transverse bars.

Preferably, each of the transverse bars has two opposite ends each provided with an end cap, and each of the magnetic members has two opposite ends each secured by the end cap.

Preferably, each of the magnetic members is a strong magnet.

Preferably, each of the magnetic members has a length the same as that of each of the transverse bars.

Preferably, the movable shading pieces are defined by a plurality of longitudinal slits each of which extends from a bottom of the second shading portion to the second tubular portion.

Preferably, each of the transverse bars has a hollow interior and has a top face provided with a recessed arcuate positioning portion.

Preferably, the first tubular portion is located at a top of the shade cloth member, and the second tubular portion is located between the first tubular portion and a central position of the shade cloth member.

Preferably, the first shading portion is located between the first tubular portion and the second tubular portion, and the second shading portion is located under the second tubular portion.

According to the primary advantage of the present invention, the second shading portion can regulate the incident sunlight passing through the shade cloth member by expanding, partially folding or fully folding each of the movable shading pieces so as to freely adjust the shading effect of the shade cloth member, thereby facilitating the user changing the indoor brightness, and thereby providing a comfortable sensation to the user.

According to another advantage of the present invention, the user only needs to move the transverse bars to connect or separate the magnetic members so as to fold or expand each of the movable shading pieces so that each of the movable shading pieces is expanded and folded easily and conveniently, thereby facilitating the user expanding or folding the shade.

According to a further advantage of the present invention, the arrangements of the movable shading pieces can be changed arbitrarily so that the user can freely regulate the shading effect of the shade cloth member according to the environmental conditions.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
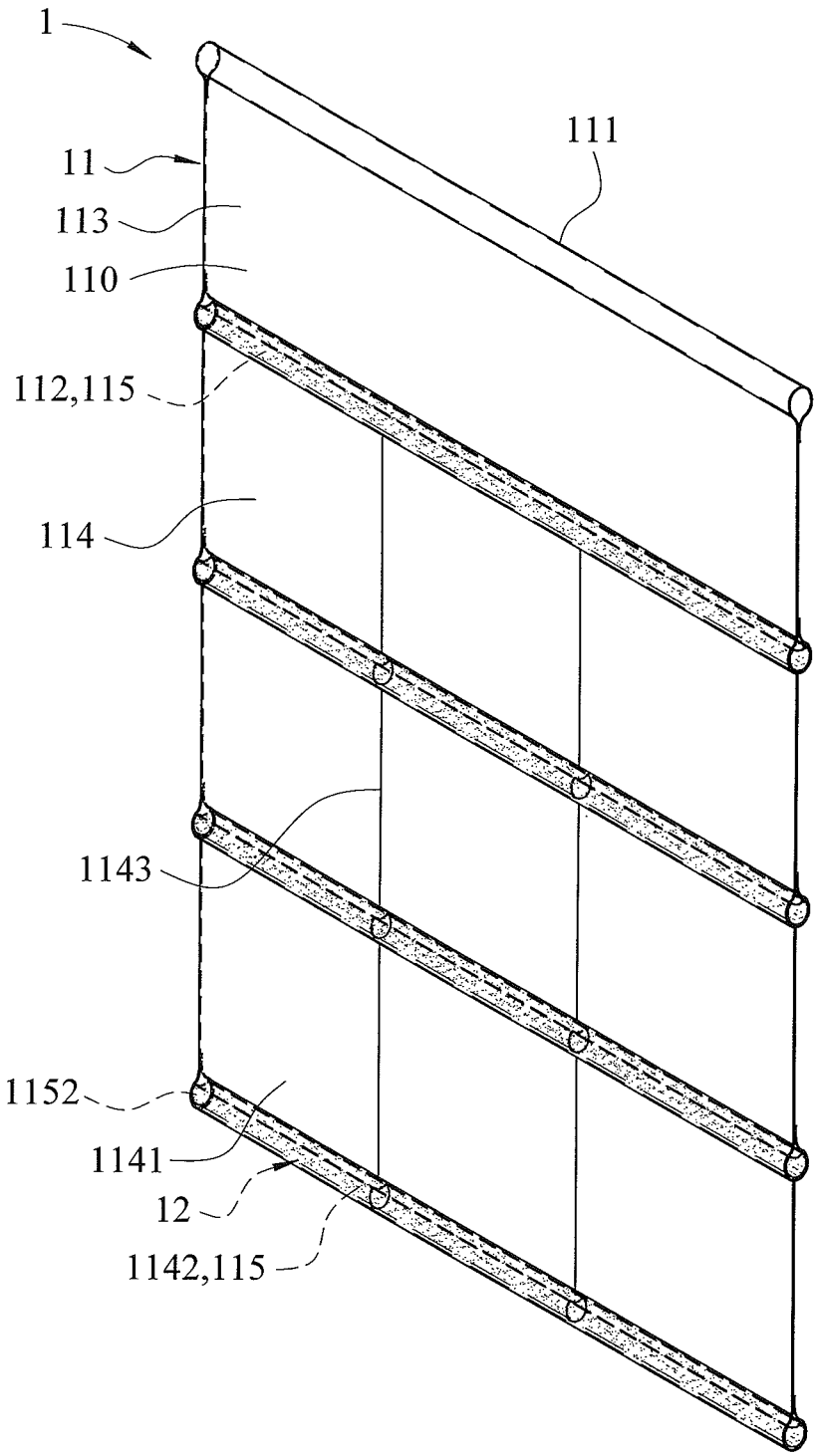
FIG. 1 is a perspective view of a shade in accordance with the preferred embodiment of the present invention.
Figure 2:
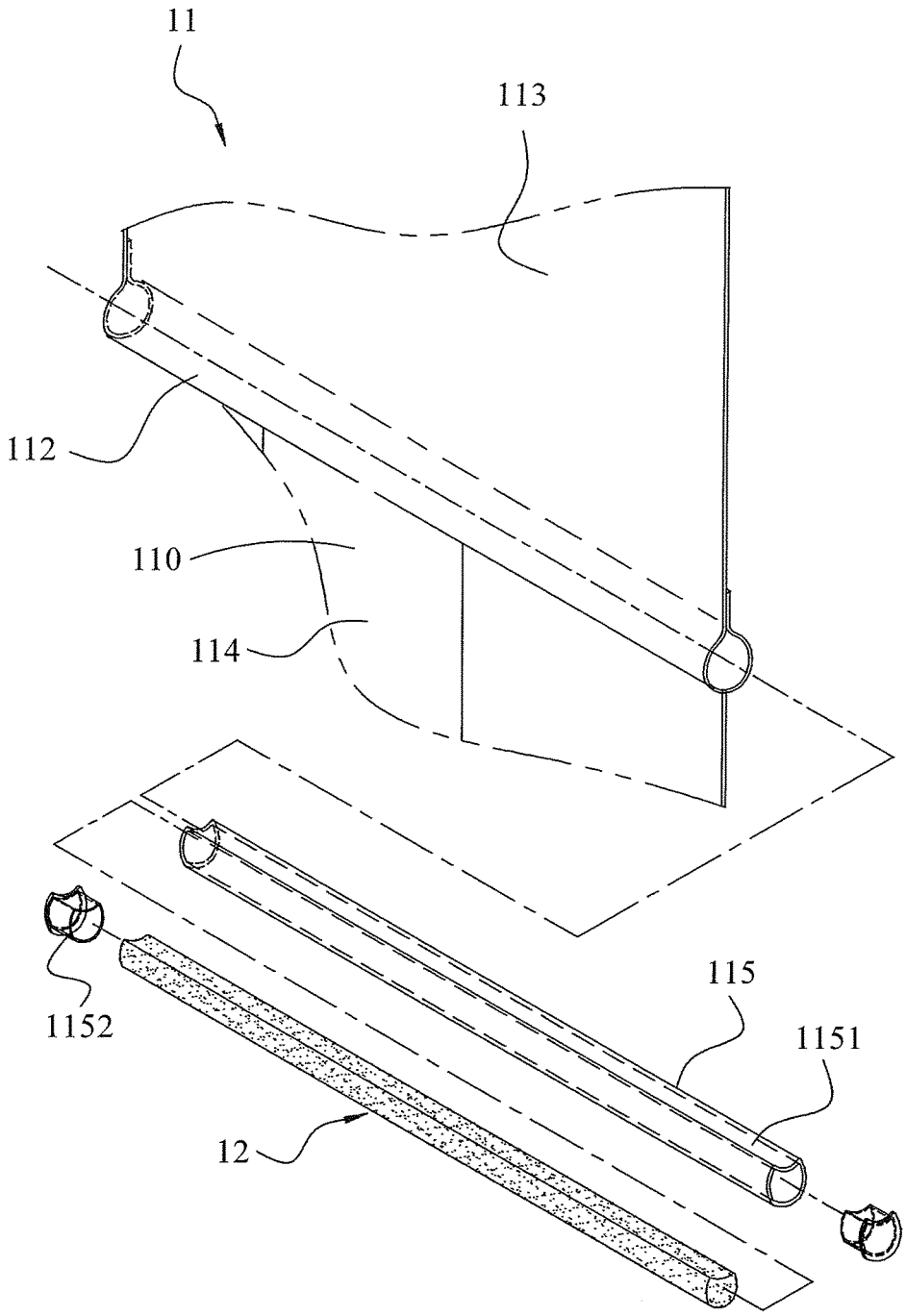
FIG. 2 is a partially exploded perspective view of the shade as shown in FIG. 1.

Referring to the drawings and initially to FIGS. 1-5, a shade 1 in accordance with the preferred embodiment of the present invention comprises a main unit 11 and a plurality of magnetic members 12 mounted on the main unit 11.

The main unit 11 includes a shade cloth member 110 and a plurality of transverse bars 115 mounted on the shade cloth member 110.

The shade cloth member 110 has a predetermined length and has a surface provided with a plurality of patterns. The shade cloth member 110 is provided with a first tubular portion 111 and a second tubular portion 112 by sewing. The first tubular portion 111 is located at a top of the shade cloth member 110. The second tubular portion 112 is located between the first tubular portion 111 and a central position of the shade cloth member 110. The shade cloth member 110 is divided into a first shading portion 113 and a second shading portion 114. The first shading portion 113 is located between the first tubular portion 111 and the second tubular portion 112. The second shading portion 114 is located under the second tubular portion 112 and is divided into a plurality of movable shading pieces 1141 which are juxtaposed to each other. The movable shading pieces 1141 are defined by a plurality of longitudinal slits 1143 each of which extends from a bottom of the second shading portion 114 to the second tubular portion 112. Each of the movable shading pieces 1141 is provided with a plurality of transverse mounting sleeves 1142 by sewing so that each of the movable shading pieces 1141 presents a multi-stage state. In the preferred embodiment of the present invention, the first tubular portion 111, the second tubular portion 112 and each of the mounting sleeves 1142 are formed by rolling the shade cloth member 110.

The transverse bars 115 are mounted in the second tubular portion 112 and the mounting sleeves 1142 of the movable shading pieces 1141, with a respective transverse bar 115 being mounted in the second tubular portion 112, and with respective transverse bars 115 being mounted in respective sleeves 1142 of the movable shading pieces 1141. Each of the transverse bars 115 has a hollow interior and has a top face provided with a recessed arcuate positioning portion 1151. Each of the transverse bars 115 has two opposite ends each provided with an end cap 1152.

The magnetic members 12 are mounted in the transverse bars 115 and are magnetically attracted by each other. Each of the magnetic members 12 is a strong magnet and has two opposite ends each secured by the end cap 1152. Each of the magnetic members 12 has a length the same as that of each of the transverse bars 115. In addition, each of the magnetic members 12 has a profile corresponding to that of each of the transverse bars 115.

Figure 4:
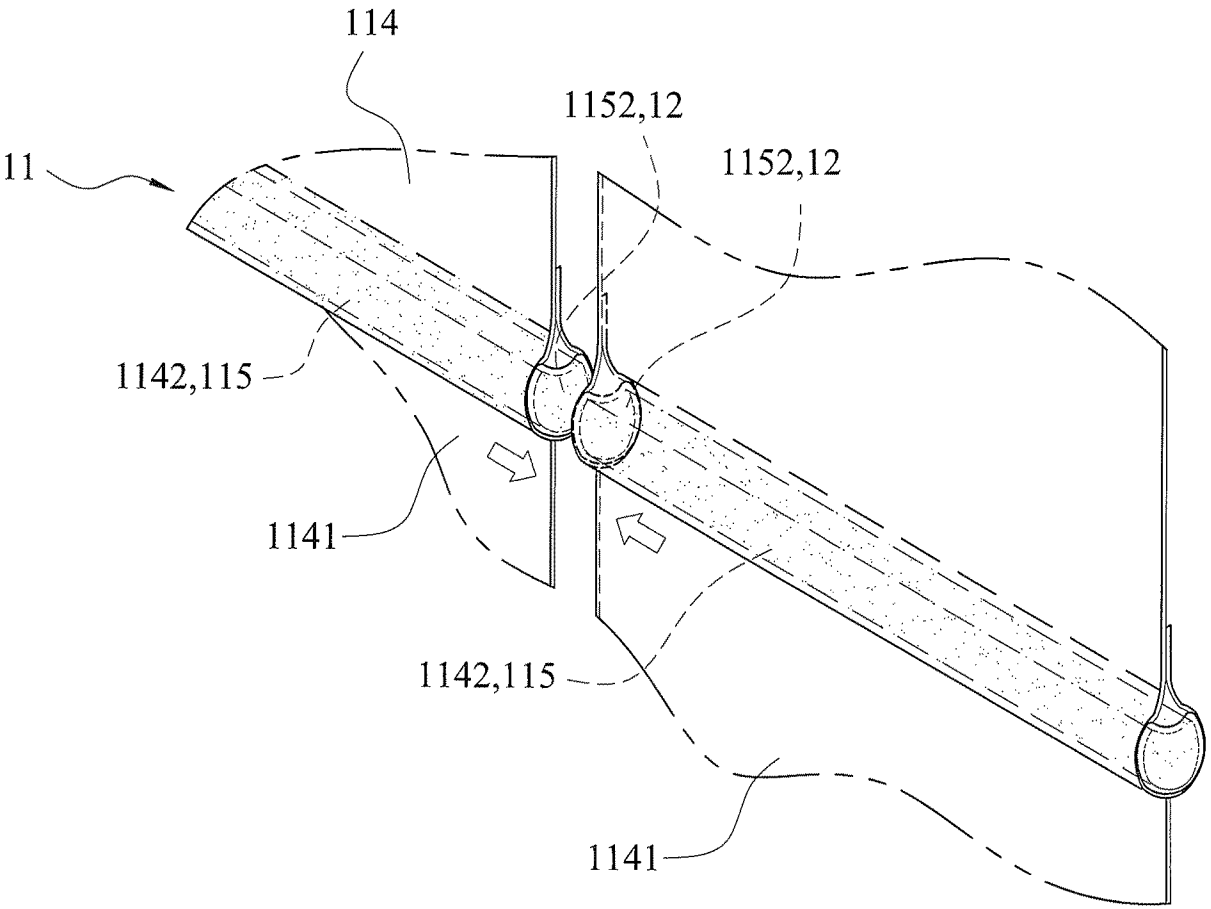
FIG. 4 is a locally enlarged view of the shade as shown in FIG. 1.

As shown in FIGS. 1 and 4, the magnetic members 12 of any two adjacent movable shading pieces 1141 are magnetically attracted by each other so that the movable shading pieces 1141 of the second shading portion 114 closely abut each other without separation. Thus, each of the movable shading pieces 1141 is fully expanded so that the second shading portion 114 depends downward to provide a shading effect.

Figure 3:
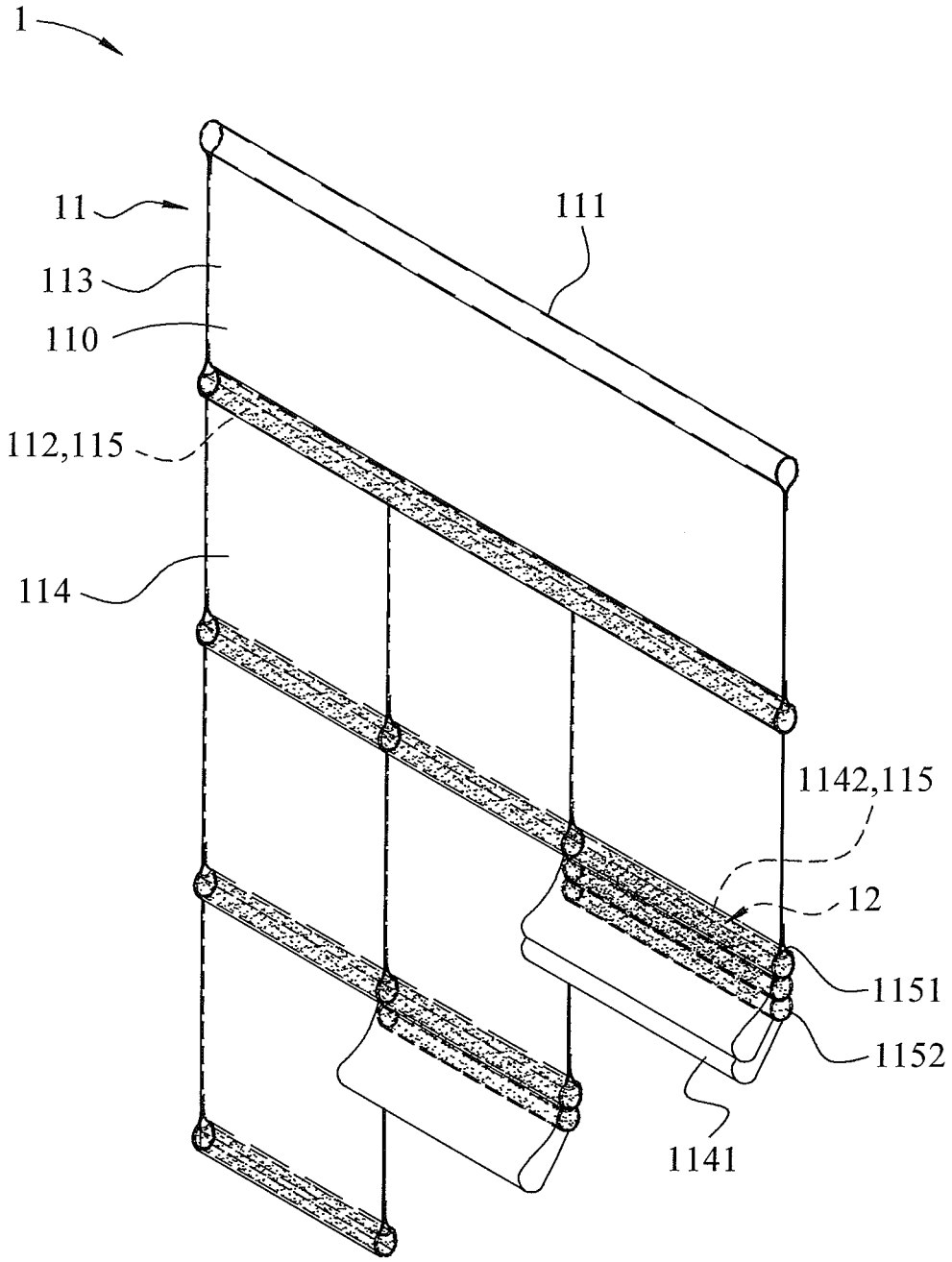
FIG. 3 is a partially folded view of the shade as shown in FIG. 1.

As shown in FIG. 3, some of the magnetic members 12 are magnetically attracted mutually so that each of the movable shading pieces 1141 is fully expanded or partially folded.

Figure 5:
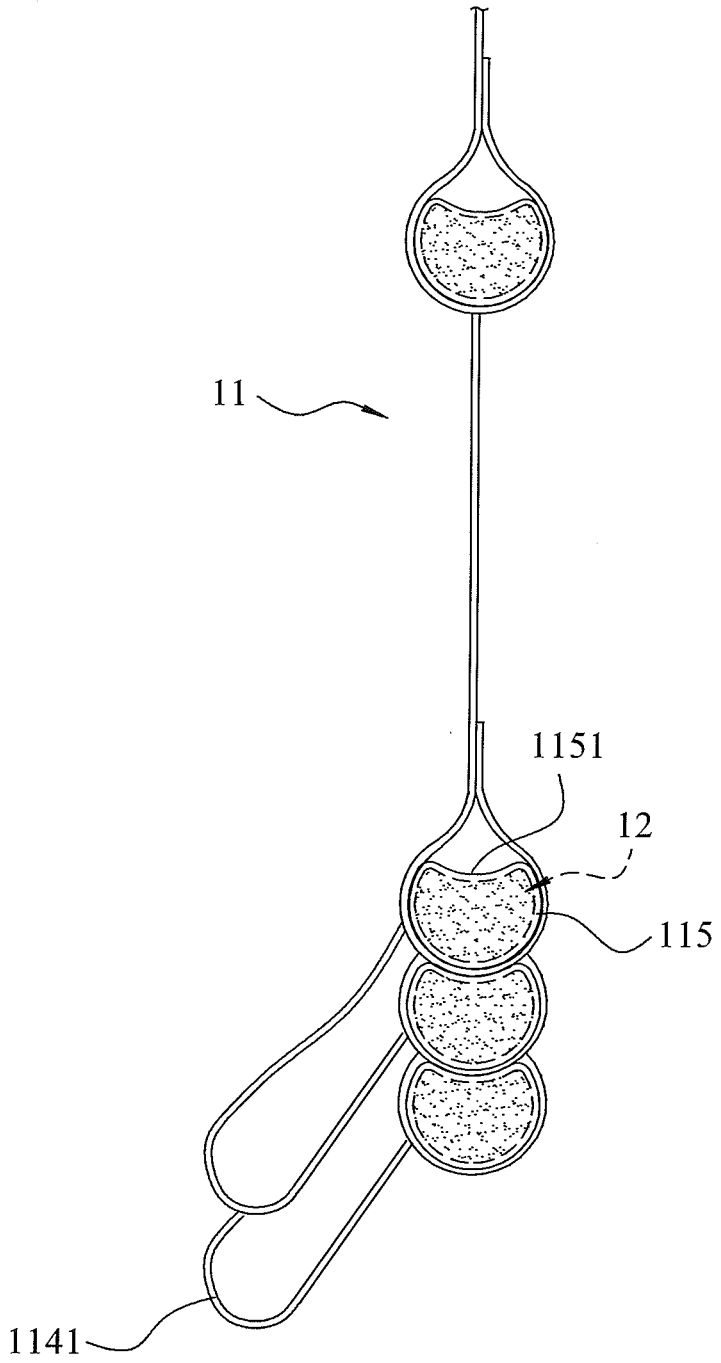
FIG. 5 is a partially side view of the shade as shown in FIG. 3.

As shown in FIG. 5, the magnetic members 12 are magnetically attracted mutually so that the transverse bars 115 are stacked in an upright manner. At this time, the recessed arcuate positioning portion 1151 of one of the transverse bars 115 is mounted on the bottom of another one of the transverse bars 115 so that the transverse bars 115 are positioned mutually and will not slip easily.

Figure 6:
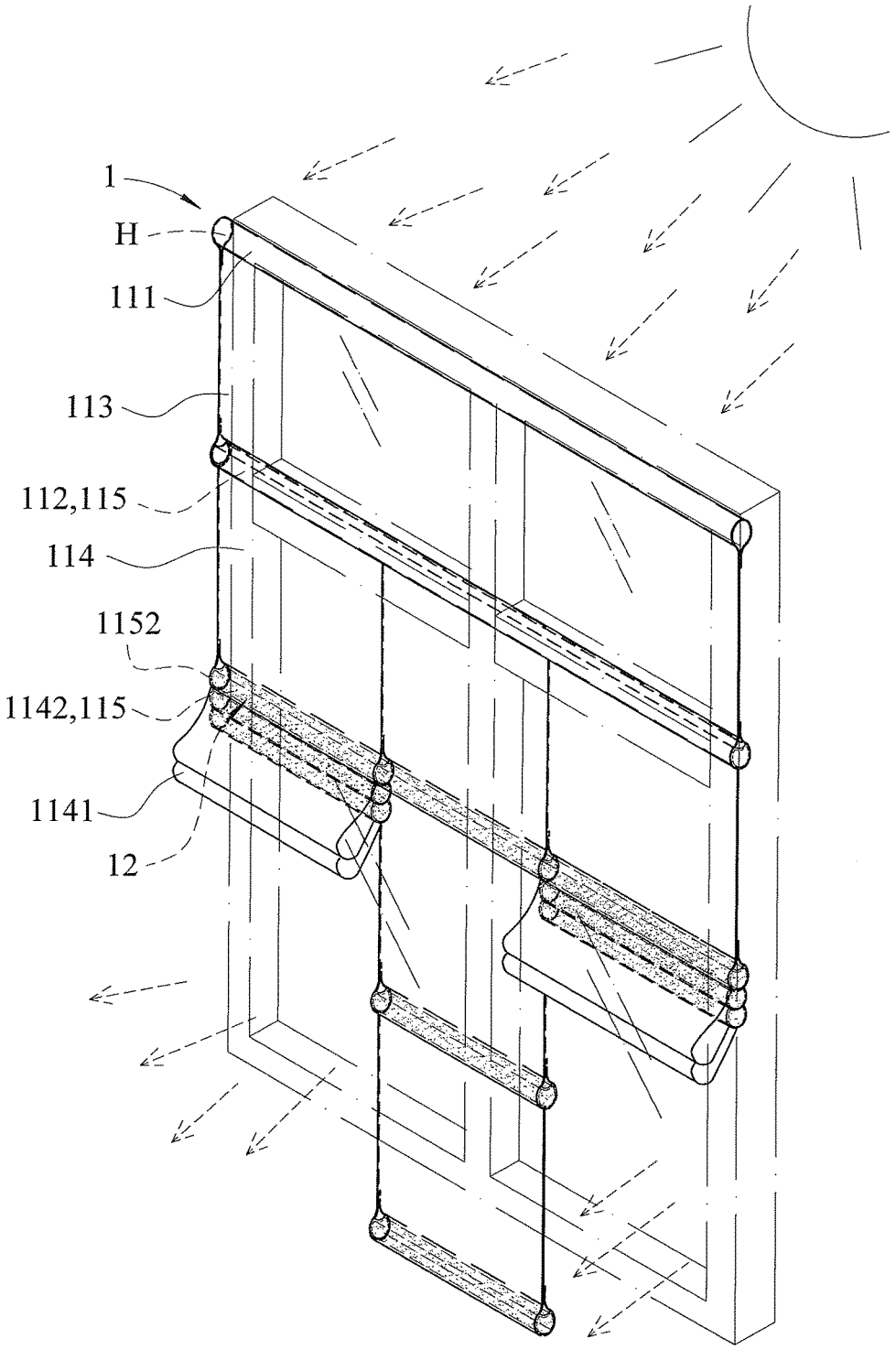
FIG. 6 is a schematic operational view of the shade as shown in FIG. 1 in use.
Figure 7:
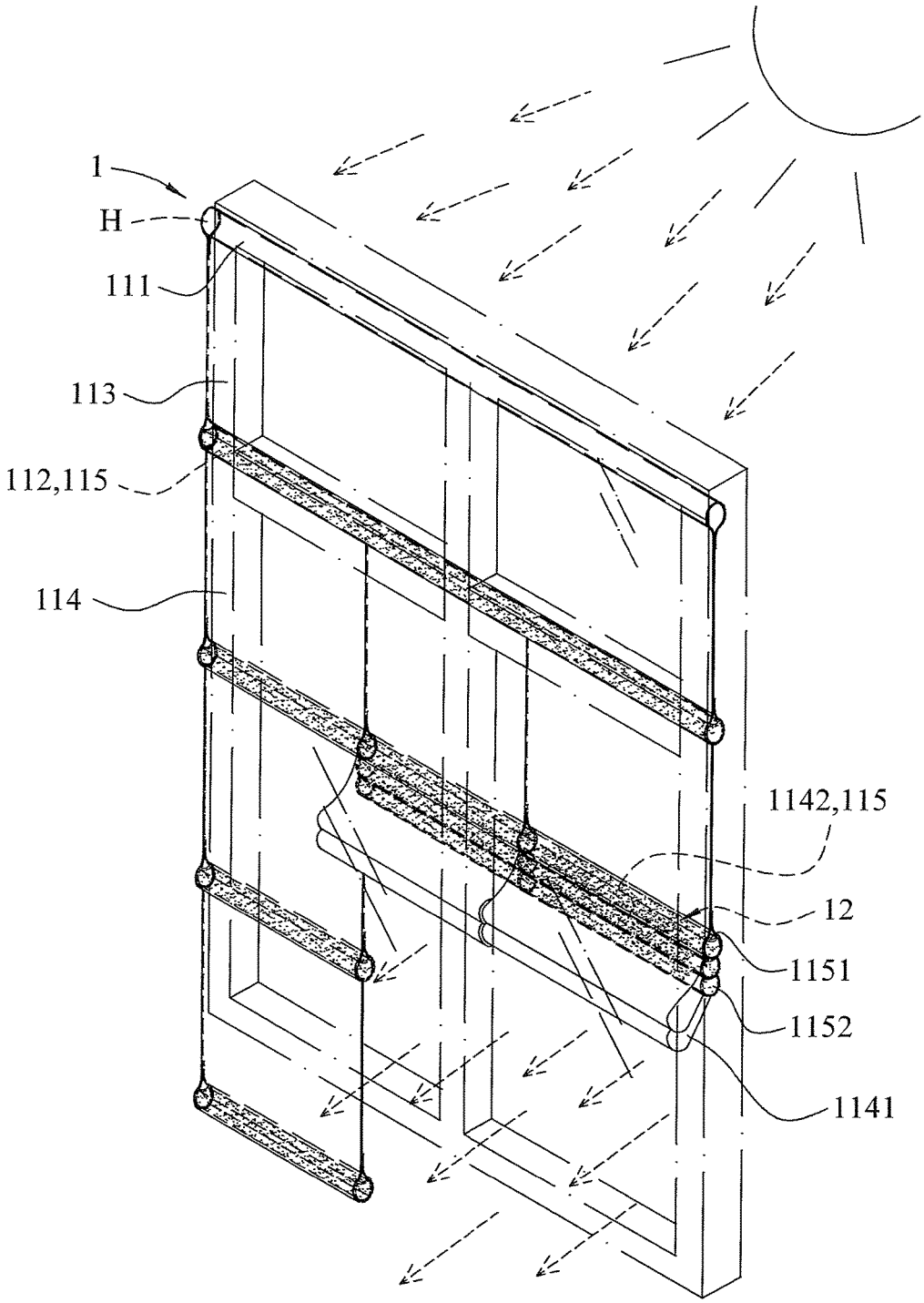
FIG. 7 is a schematic operational view of the shade as shown in FIG. 1 in use.
Figure 8:
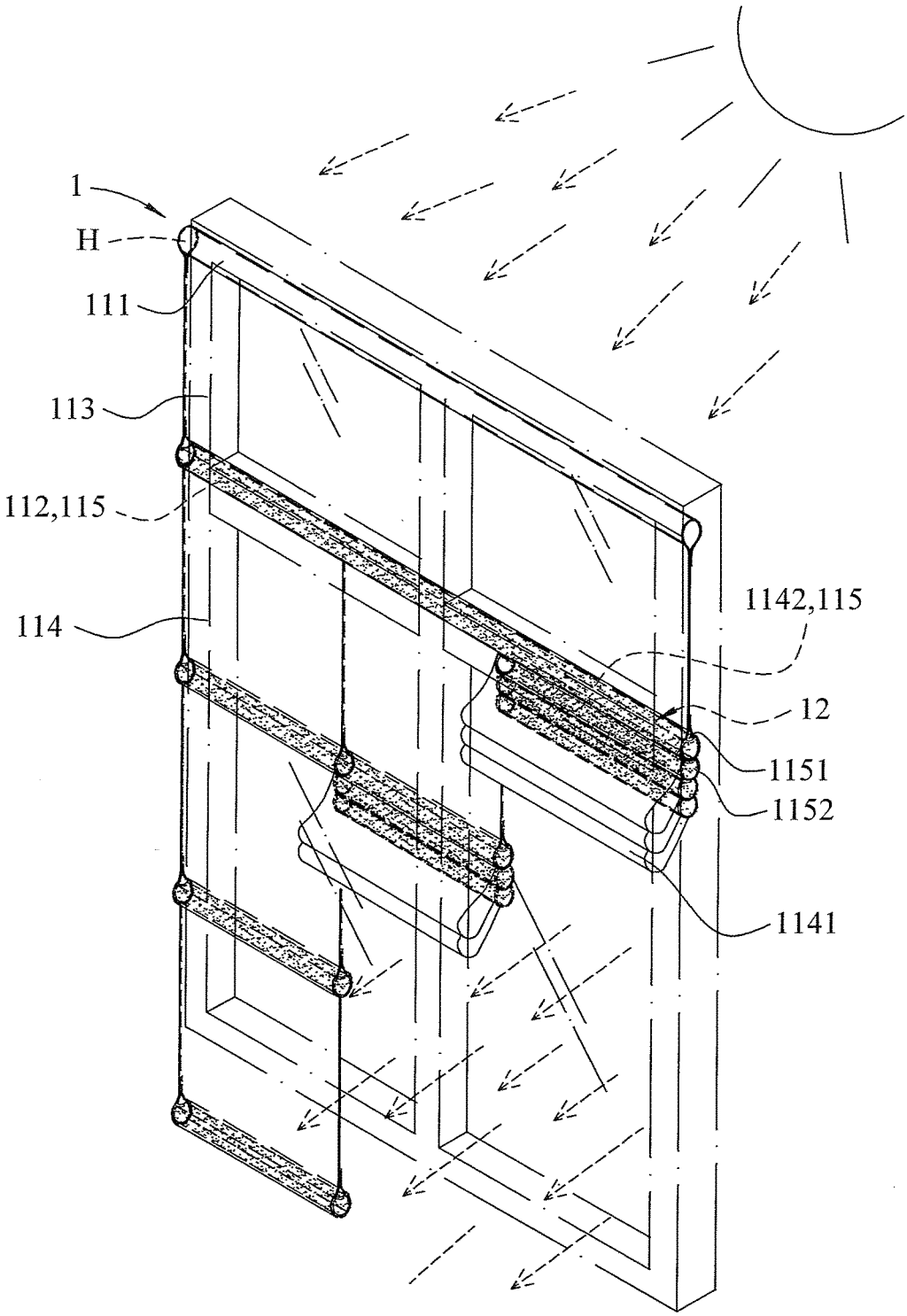
FIG. 8 is a schematic operational view of the shade as shown in FIG. 1 in use.

In operation, referring to FIGS. 6-8 with reference to FIGS. 1-5, the first tubular portion 111 is mounted on a support rod "H" which is mounted on a window frame to attach the shade 1 to the window frame. In such a manner, each of the movable shading pieces 1141 can be fully expanded, can be partially folded, can be half folded, and can be fully folded as shown in FIGS. 6-8, so that the second shading portion 114 can adjust the incident sunlight passing through the shade cloth member 110 by different arrangements of each of the movable shading pieces 1141 so as to regulate the shading effect and the indoor brightness, thereby providing a comfortable sensation to the user.

Accordingly, the second shading portion 114 can regulate the incident sunlight passing through the shade cloth member 110 by expanding, partially folding or fully folding each of the movable shading pieces 1141 so as to freely adjust the shading effect of the shade cloth member 110, thereby facilitating the user changing the indoor brightness, and thereby providing a comfortable sensation to the user. In addition, the user only needs to move the transverse bars 115 to connect or separate the magnetic members 12 so as to fold or expand each of the movable shading pieces 1141 so that each of the movable shading pieces 1141 is expanded and folded easily and conveniently, thereby facilitating the user expanding or folding the shade 1. Further, the arrangements of the movable shading pieces 1141 can be changed arbitrarily so that the user can freely regulate the shading effect of the shade cloth member 110 according to the environmental conditions.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A shade comprising:

a main unit; and a plurality of magnetic members mounted on the main unit;

wherein:

the main unit includes:

a shade cloth member; and a plurality of transverse bars mounted on the shade cloth member;

the shade cloth member is provided with a first tubular portion and a second tubular portion;

the shade cloth member is divided into a first shading portion and a second shading portion;

the second shading portion is divided into a plurality of movable shading pieces which are juxtaposed to each other;

each of the movable shading pieces is provided with a plurality of transverse mounting sleeves, with each of the movable shading pieces presenting a multi-stage state;

the transverse bars are mounted in the second tubular portion and the mounting sleeves of the movable shading pieces, with a respective one of said plurality of transverse bars being mounted in the second tubular portion, and with respective transverse bars of said plurality of transverse bars being mounted in respective mounting sleeves of the movable shading pieces;

each of the transverse bars has a hollow interior and has a top face provided with a recessed arcuate positioning portion having a concave shape and configured such that adjacent transverse bars nest stably with the arcuate recess of each transverse bar accommodating a respective bottom convex surface of each respective adjacent stacked transverse bar; and the magnetic members are mounted in the transverse bars and are magnetically attracted by each other, with the transverse bars being stacked in an upright manner, and with the recessed arcuate positioning portion of one of the transverse bars being positioned on a bottom of another one of the transverse bars to position the transverse bars in place.

2. The shade of claim 1, wherein the first tubular portion, the second tubular portion and each of the mounting sleeves are formed by rolling the shade cloth member.

3. The shade of claim 1, wherein each of the magnetic members has a profile corresponding to that of each of the transverse bars.

4. The shade of claim 1, wherein each, of the transverse bars has two opposite ends each provided with an end cap, and each of the magnetic members has two opposite ends each secured by the end cap.

5. The shade of claim 1, wherein each of the magnetic members is a magnet.

6. The shade of claim 1, wherein each of the magnetic members has a length the same as that of each of the transverse bars.

7. The shade of claim 1, wherein the movable shading pieces are defined by a plurality of longitudinal slits each of which is formed in the shade cloth member and extends from a bottom of the second shading portion to the second tubular portion, and the shade cloth member is formed with the movable shading pieces each of which has an upper end affixed to a bottom of the second tubular portion.

8. The shade of claim 1, wherein the first tubular portion is located at a top of the shade cloth member, and the second tubular portion is located between the first tubular portion and a central position of the shade cloth member.

9. The shade of claim 1, wherein the first shading portion is located between the first tubular portion and the second tubular portion, and the second shading portion is located under the second tubular portion.

* * * * *